US010849409B2

(12) United States Patent
Moncreiff

(10) Patent No.: US 10,849,409 B2
(45) Date of Patent: Dec. 1, 2020

(54) HARNESS FOR CARRYING A LOAD

(71) Applicant: Robert Moncreiff, London (GB)

(72) Inventor: Robert Moncreiff, London (GB)

( * ) Notice: Subject to any disclaimer, the term of this patent is extended or adjusted under 35 U.S.C. 154(b) by 0 days.

(21) Appl. No.: 15/308,053

(22) PCT Filed: Apr. 27, 2015

(86) PCT No.: PCT/GB2015/051222

§ 371 (c)(1),
(2) Date: Oct. 31, 2016

(87) PCT Pub. No.: WO2015/166224

PCT Pub. Date: Nov. 5, 2015

(65) Prior Publication Data

US 2017/0049218 A1 Feb. 23, 2017

(30) Foreign Application Priority Data

May 1, 2014 (GB) ..... 1407734.1

(51) Int. Cl.
*A45F 3/04* (2006.01)
*A45F 3/10* (2006.01)
*A45F 3/08* (2006.01)

(52) U.S. Cl.
CPC ..... *A45F 3/04* (2013.01); *A45F 3/047* (2013.01); *A45F 3/08* (2013.01); *A45F 3/10* (2013.01); *A45F 2003/045* (2013.01)

(58) Field of Classification Search
CPC .... A45F 3/04; A45F 3/047; A45F 3/08; A45F 3/10
See application file for complete search history.

(56) References Cited

U.S. PATENT DOCUMENTS 4,318,502 A * 3/1982 Lowe ..... A45F 3/04 224/153
4,676,418 A * 6/1987 Lowe ..... A45F 3/08 224/262

(Continued)

FOREIGN PATENT DOCUMENTS

CN 1244776 A 2/2000
CN 1674807 A 9/2005

(Continued)

OTHER PUBLICATIONS

International Search Report (ISR) from parent application PCT/GB2015/051222, dated Apr. 27, 2015.

(Continued)

*Primary Examiner* — Derek J Battisti
(74) *Attorney, Agent, or Firm* — Maschoff Brennan

(57) ABSTRACT

A harness for a back-pack comprises a chest harness (A), a strut mechanism in the form of a flexible spine (B) and a hip belt (C). The flexible spine (B) provides a sprung, damped connection between the chest harness (A) and the hip belt (C), so that the load of the backpack is transferred through the flexible spine (B) to the hip belt (C), while the flexible spine can extend to accommodate movement of the wearer's body. The chest harness (A) comprises straps (12, 15) which are interconnected at the front of the wearer by a buckle (14). Abdominal straps (15) are connected to the buckle (14) by flexible wands (16) which flex under the breathing action of the wearer to retain the load securely against the wearer's back without restricting breathing.

7 Claims, 6 Drawing Sheets

(56) References Cited

U.S. PATENT DOCUMENTS

| | | | | |
|---|---|---|---|---|
| 5,090,604 | A | 2/1992 | Howe | |
| 5,114,059 | A * | 5/1992 | Thatcher | A45F 3/04 224/148.5 |
| 5,954,253 | A * | 9/1999 | Swetish | A45F 3/08 224/628 |
| 5,957,355 | A * | 9/1999 | Swetish | A45F 3/04 224/627 |
| 5,984,157 | A * | 11/1999 | Swetish | A45F 3/10 224/631 |
| 6,283,350 | B1 * | 9/2001 | Gottmeier | A45F 3/04 224/627 |
| 6,290,111 | B1 * | 9/2001 | Hedenberg | A45F 3/10 224/262 |
| 7,851,932 | B2 * | 12/2010 | Rome | A45F 3/08 224/576 |
| 8,172,117 | B2 * | 5/2012 | Maggi | A45F 3/047 224/263 |
| 8,424,731 | B2 * | 4/2013 | Lifshitz | A47D 13/02 224/158 |
| 9,756,920 | B2 * | 9/2017 | Spears | A45C 13/30 |
| 2014/0001220 | A1 * | 1/2014 | Brensinger | A45F 3/04 224/637 |
| 2015/0157114 | A1 * | 6/2015 | Janssen | A45F 3/04 224/265 |

FOREIGN PATENT DOCUMENTS

| | | | |
|---|---|---|---|
| DE | 29906531 | U1 | 8/1999 |
| WO | 2004/026071 | A1 | 4/2004 |
| WO | 2013/169100 | A1 | 11/2013 |

OTHER PUBLICATIONS

Written Opinion (WO), from parent application PCT/NZ2015/051222, dated Apr. 27, 2015.

CN Office Action dated Dec. 11, 2017 as received in Application No. 201580035690.7 (Machine Translation).

* cited by examiner

HARNESS FOR CARRYING A LOAD

FIELD OF THE INVENTION

This invention relates to a harness for carrying a load, and is particularly, although not exclusively, concerned with a harness for use with a backpack such as a rucksack.

BACKGROUND OF THE INVENTION AND PRIOR ART

Conventional rucksacks comprise a pack provided with a waistband which extends around the wearer's waist above the hips, and a pair of shoulder straps which extend from positions near or at the base of the pack over the front of the wearer and over the shoulders to be attached to the pack adjacent the back of the wearer on each side of the pack. The intention is for the load carried in the pack to be supported primarily by the waistband rather than the shoulders, and to minimise any tendency of the load to pull backwards on the wearer.

Such conventional rucksacks have the following disadvantages:

1. The shoulder straps are connected by the pack (and sometimes directly) to the waistband. Consequently, the rucksack is not able to conform fully to movements of the wearer. In particular, typical movements of the wearer involve significant variation in the distance between the top of the shoulders and hips, for example during movements of the shoulders or sideways bending of the torso. Also, this distance can vary as a result of the extension of the spine during bending and twisting. Tests have shown that the spine extends by approximately 6 cm when a person moves from an upright position to touch their toes. Straps in conventional rucksacks have a vertically load-bearing function, and are connected to the base of the pack at each side. Consequently, there can be little vertical movement between the shoulder straps and the waistband, with the result that any variation in the distance between the wearer's shoulders and their hips means that the weight distribution of the pack constantly shifts between the waistband and the shoulder straps. The result of this is that the pack tends to bounce on the shoulders, with the waistband riding upwards on the hips. This is particularly prevalent when the wearer is performing faster movements such as running. The usual response of the wearer is to tighten the shoulder straps to restrict bouncing, but this results in more of the weight of the pack being supported by the shoulders. As a consequence, the wearer tends to round their shoulders and stoop forwards, so eliminating the natural curvature of the spine and causing excessive strain on both the spine and the muscles of the pack. This additional strain is exacerbated by any remaining "bounce" which occurs.

2. In conventional rucksacks, the shoulder straps are intended to carry approximately 30% of the load, with the remainder being supported by the waistband. The shoulder straps pass over the top of the acromion (the extension of the shoulder blade that connects to the end of the clavicle bone), which is attached to the main skeletal structure through muscles and other soft tissues. As a result the wearer experiences significant muscle fatigue when wearing the pack for any length of time. Since the acromion is highly mobile with any shoulder movement, movement of the arms exacerbates this muscle fatigue in the shoulder and back. Additionally the slope of the top of the shoulders and the weight of the rucksack pulling on the shoulder straps pulls the straps backwards and sideways away from the centre of the body.

In order to overcome this effect, it is known to provide chest straps which extend between the shoulder straps at the front of the wearer's body. The purpose of these chest straps is to prevent the shoulder straps from slipping sideways off the shoulders. The chest straps do not support any vertical load, typically being elasticated, and so are not effective to transfer loads from the pack to the wearer's body.

3. Conventional rucksacks draw the entire back panel of the rucksack (i.e. the panel facing the wearer) against the wearer's back by way of the waist belt and shoulder straps. Consequently, the rucksack cannot accommodate relative movement between different parts of the wearer's back. Also, the pack is pressed against moving parts of the body, and in particular the highly mobile shoulder blades. This restricts the wearer's movements, and causes discomfort from rubbing of the wearer's body against the pack.

To alleviate these problems, it is known to use a tensioned mesh back panel that creates an airspace between the pack and the wearer's back to keep it cool and free of perspiration. However, this reduces the load support, and pushes the pack load further behind the wearer so tending to pull the wearer backwards. A similar problem arises if extra padding is applied, especially over the shoulder blades. While this may alleviate some discomfort, it does not address the root cause of the issue and can additionally restrict the wearer's movements.

The issues referred to above become particularly acute as the wearer's movements become faster and/or more extreme, for example when the wearer is running. Consequently, backpacks intended for runners tend to be relatively lightweight, without a load-bearing waistband or any other mechanism for transferring load onto the wearer's hips. The load is thus supported fully by the shoulders, so severely restricting the load that can realistically be carried.

4. As mentioned above, a conventional response to a rucksack "bouncing" on the wearer's back is to tighten the shoulder straps and conventional shoulder straps do not secure a pack to the wearer's upper back as closely as users typically would like. However, conventional designs cannot overcome this as any conventional solutions cannot prevent restriction of the wearer's breathing, since the breathing action is accompanied by expansion and contraction of the rib cage.

SUMMARY OF THE INVENTION

According to one aspect of the present invention there is provided a harness for carrying a load, the harness comprising a support structure provided with a strap arrangement for retaining the support structure adjacent a wearer's back, the strap arrangement comprising left and right chest straps, each chest strap comprising a loop extending from a first position on the support structure on one side of the support structure to a second position below the first position on the same side of the support structure, the chest straps being interconnected, in use, at the front of the wearer by a releasable buckle comprising left and right buckle components, each loop comprising an upper flexible portion extending from the support structure to an upper fastening point on the respective buckle component and a lower flexible portion extending from the support structure to an attachment point at one end of a link, the other end of the link being connected to a lower fastening point on the respective buckle component, whereby the attachment points of the lower flexible portions are laterally displaceable towards and away from each other by deflection of at least one of the links (16).

This arrangement enables the harness to be fitted tightly to the wearer's back by means of the chest straps, while permitting the wearer's rib cage to expand when breathing in, such expansion being accommodated by movement apart from each other of the attachment points of the lower flexible portions.

The loop of each chest strap may be made from a substantially inextensible material so that rib cage expansion is accommodated substantially solely by lateral displacement of the attachment points of the lower flexible portions. The length of each loop may be adjustable so that the harness can be adapted to the body shape and size of the wearer.

The buckle components, when engaged with each other, may form a rigid interconnection between the loops. As a result, vertical forces can be transmitted between the loops.

Each link may comprise an inextensible but flexible wand. Each wand may be rigidly connected to the respective buckle component, so that deflection of the links is achieved by flexure of the respective wand. In an alternative embodiment, each wand may be substantially rigid, but connected to the respective buckle component in a resiliently pivoting manner.

The harness may comprise a hip belt connected to the support structure by a strut mechanism which, in use, resiliently biases the support structure upwards with respect to the hip belt.

The strut mechanism may comprise the sole force transmitting connection between the hip belt and the support structure. The strut mechanism may be laterally flexible.

According to another aspect of the present invention, there is provided a harness for a backpack comprising a support structure provided with a strap arrangement for retaining the support structure adjacent a wearer's back, the harness also comprising a hip belt connected to the support structure by a strut mechanism which, in use, resiliently biases the support structure upwards with respect to the hip belt, the strut mechanism comprising at least one telescopic strut.

In the context of this specification, a telescopic strut is to be understood as a strut comprising two components which are linearly slidable one within the other to vary the length of the strut.

In one embodiment, a spring may be provided which acts in a direction to extend the strut mechanism, and means may be provided for damping extension of the strut mechanism.

The strut mechanism may comprise a single upwardly extending strut disposed substantially centrally of a wearer's back when in use. The strut mechanism may comprise a telescopic strut having a piston displaceable in a cylinder, the piston and the cylinder being connected respectively to one and the other of the hip belt and the support structure.

The strut mechanism may incorporate a piezoelectric device to generate electricity.

The present invention also provides a backpack comprising a harness as defined above.

BRIEF DESCRIPTION OF THE DRAWINGS

For a better understanding of the present invention and to show more clearly how it may be carried into effect, reference will now be made, by way of example, to the accompanying drawings, in which.

DETAILED DESCRIPTION OF PREFERRED EMBODIMENTS

In this specification, the terms left, right, up, down, front and back and similar directional or positional terms refer to the harness when worn by a wearer standing upright and as perceived by the wearer themselves.

Figure 1:
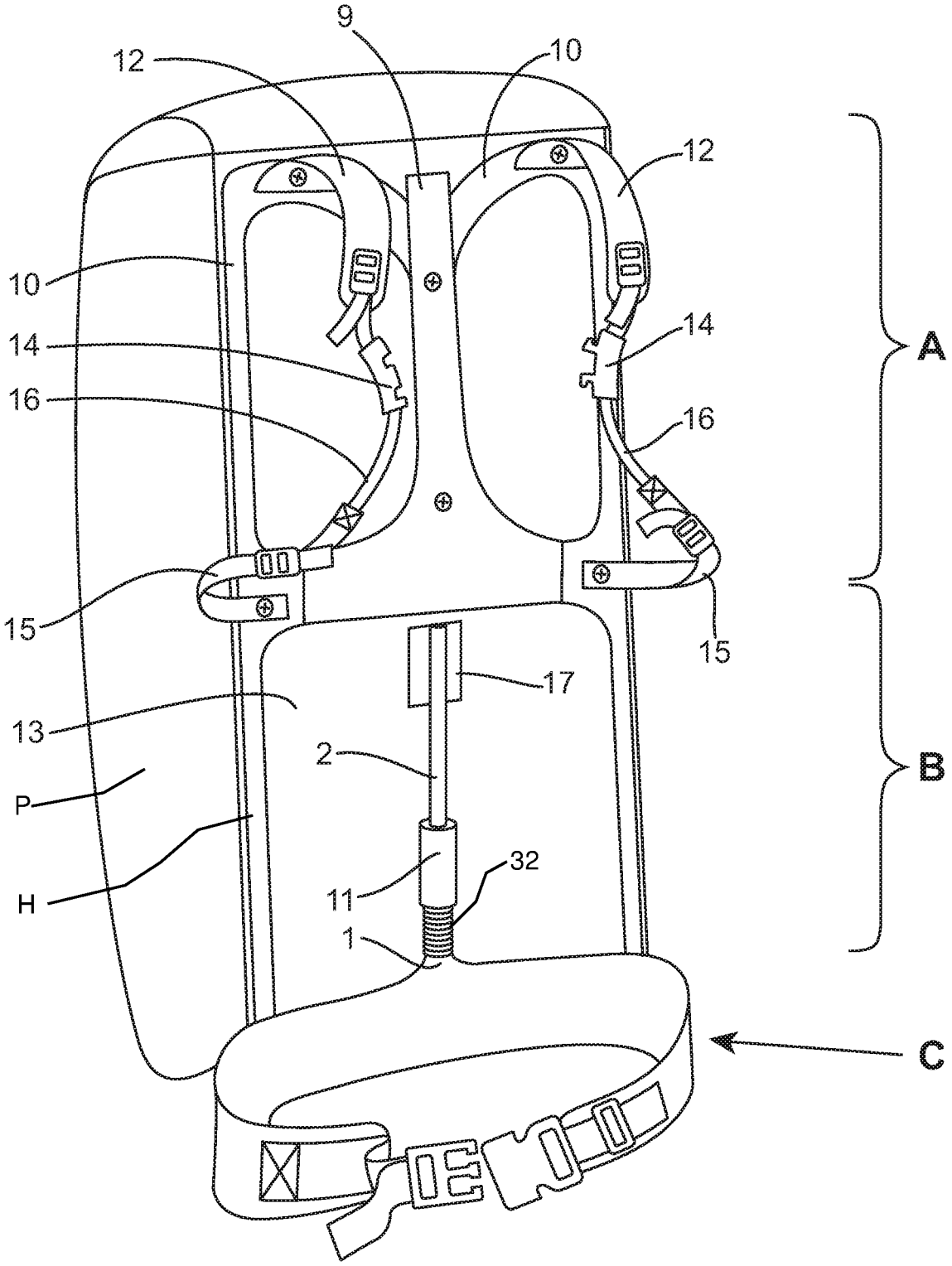
FIG. 1 shows a rucksack.

As shown in FIG. 1, the rucksack comprises a harness H on which a pack P is mounted. The harness comprises a support structure comprising a central spar 9 and a pair of lateral spars 10 to which are connected a chest strap arrangement A, a strut mechanism B and a hip belt C.

The chest strap arrangement A comprises left and right chest straps, each of which forms with the support structure a closed loop and is made up of an upper flexible portion 12 and a lower flexible portion 15, made from flexible webbing. Each flexible portion 12 is connected at its upper end to an upper part of the respective lateral spar 10 and each lower flexible portion 15 is connected at its lower end to the same lateral spar 10 as the upper flexible portion 12 of the same chest strap, at a position approximately midway between the upper and lower ends of the respective lateral spar 10.

The upper and lower flexible portions 12, 15 of each chest strap are interconnected at their ends opposite the attachment points to the support structure 9, 10 by a respective buckle component 14 and a link in the form of a flexible wand 16. Thus, the end of each upper flexible portion 12 away from its attachment point to the support structure 9, 10 is attached to an upper region of the respective buckle component 14 at an upper fastening point on the buckle component 14. The upper end of the flexible wand 16 is rigidly secured to the lower region of that buckle component 14 at a lower fastening point on the buckle component 14, while the lower end of the flexible wand 16 is attached at an attachment point to the end of the lower flexible portion 15 away from its attachment point to the support structure 9, 10. The flexible wands 16 may, for example, be made from a stiff composite material which is resiliently flexible in bending under the forces applied to it during breathing of a wearer of the rucksack as will be described below.

The buckle components 14 of the two chest straps 12, 15, can be interconnected in a rigid manner, i.e. a manner which does not permit relative vertical displacement between them. Consequently, when the buckle is fastened, the chest straps 12, 15 can transfer vertical forces between them through the buckle 14.

The upper and lower flexible portions 12, 15 are provided with adjustment buckles which enable the chest straps to be adjusted to fit the individual size and shape of the wearer.

The hip belt C is made from flexible webbing provided with a waist buckle mechanism incorporating adjustment means to enable the waist belt to be fitted to the wearer. The hip belt C is connected to the support structure 9, 10 only by the strut mechanism B but is otherwise movable with respect to the support structure 9, 10.

Figure 2:
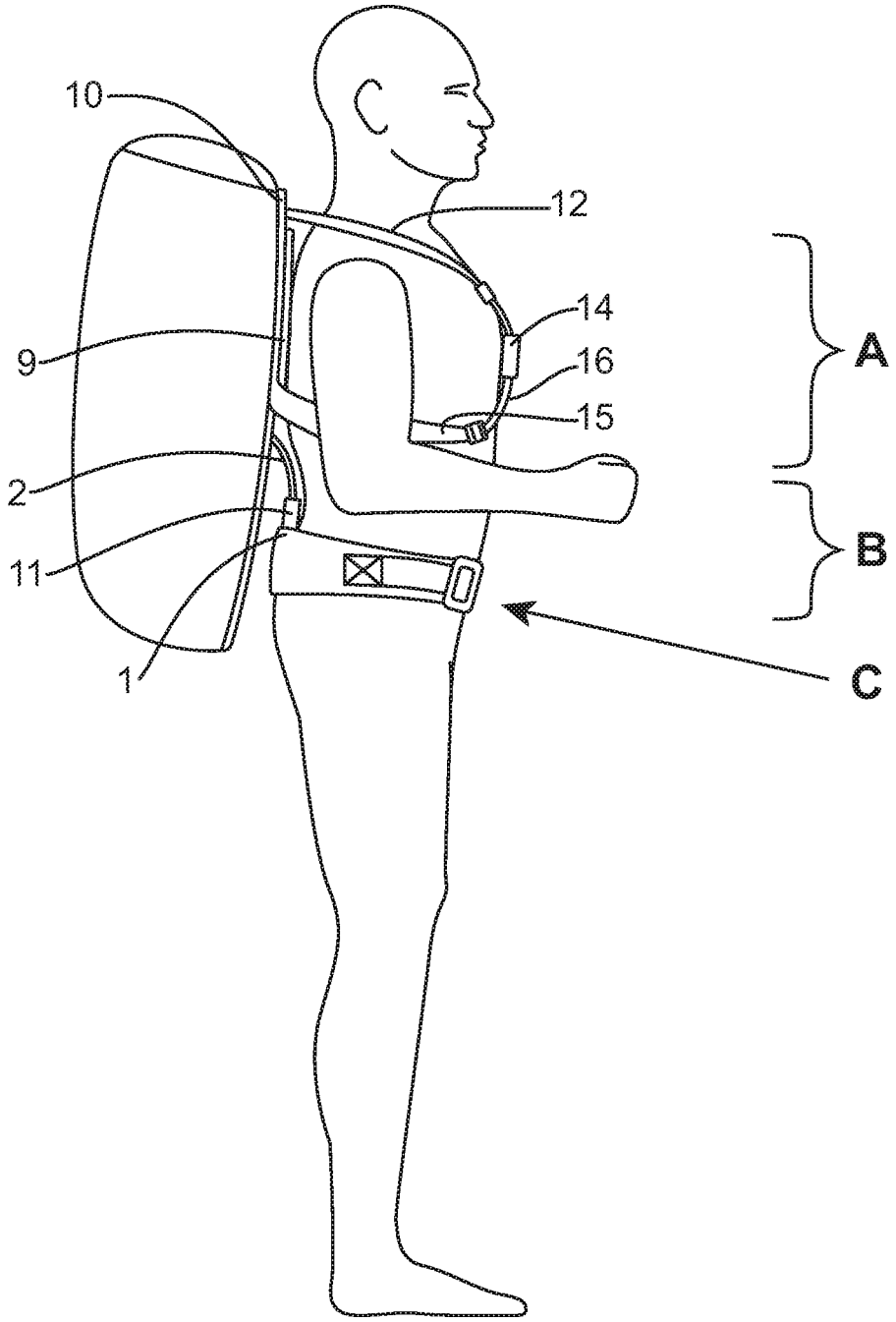
FIG. 2 shows the rucksack of FIG. 1 positioned on a wearer.
Figure 3:
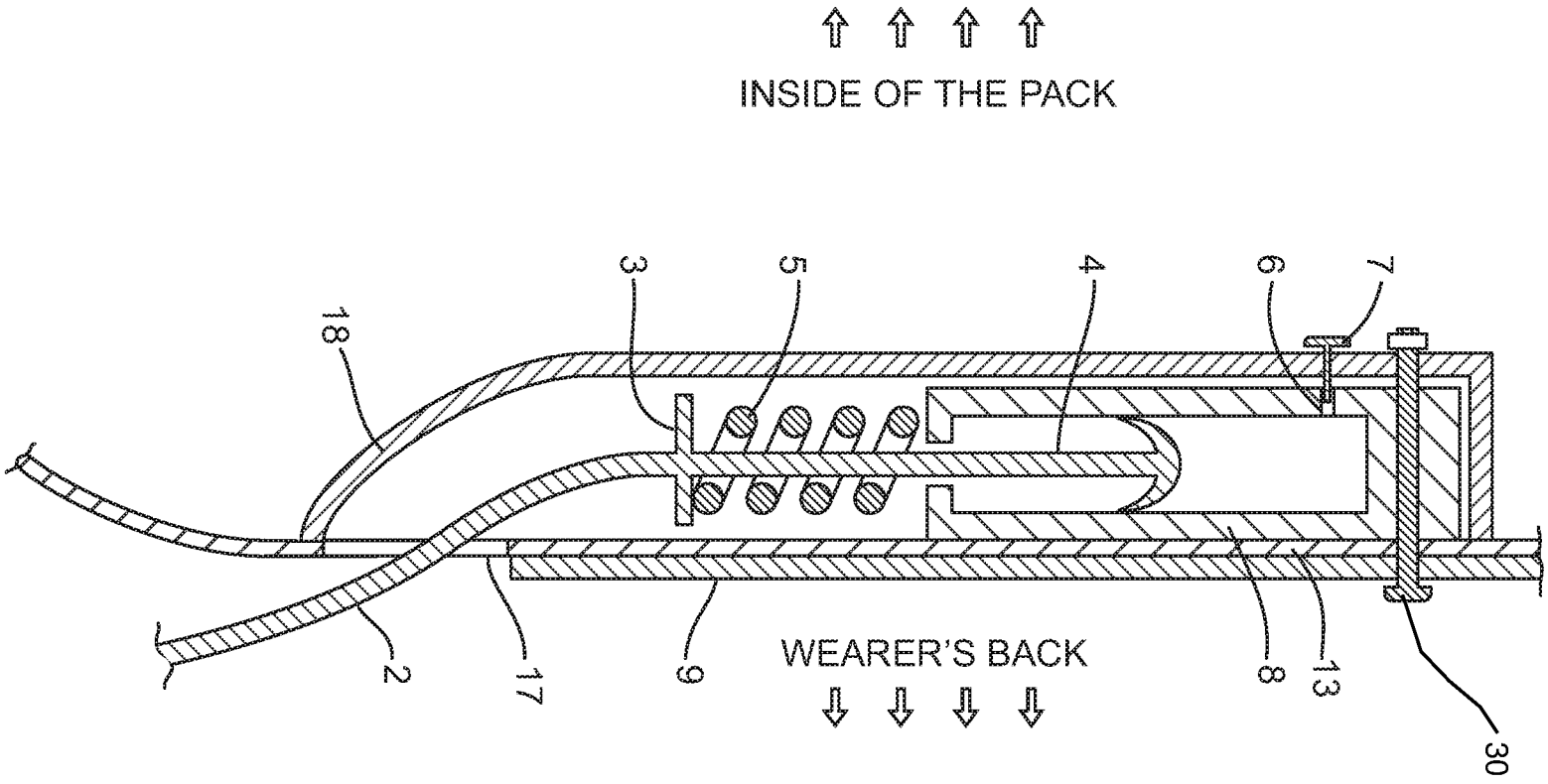
FIG. 3 is a sectional view of a sprung, damped strut mechanism suitable for use with the rucksack of FIGS. 1 and 2.

The strut mechanism B shown in FIGS. 1 to 3 comprises a piston 4 which is movable within a cylinder 8. A spring 5 acts between the lower end of the cylinder 8 and a flange 3 on the flexible rod 2. The piston 4, cylinder 8 and spring 5 are accommodated within a housing 18 which is mounted on the inside face of the back panel 13 of the pack P in order to protect the strut mechanism from the contents of the pack P. The housing 18, the cylinder 8, the back panel 13 and the central spar 9 of the support structure are secured together, for example by means of a screw and nut fastener 30. There is a hole 17 in the back panel 13 below the end of the central spar 9 through which the flexible rod 2 extends, to be connected to the hip belt C as shown in FIGS. 1 and 2. The flexible rod 2 is adjustable with respect to the hip belt C by means of a screw adjuster 11.

For use the rucksack is placed on a wearer as shown in FIG. 2. With the buckle 14 undone, and the buckle on the hip belt C undone, the wearer passes his or her arms through the loops formed by the flexible portions 12, 15, 14 and 16. The buckle 14 is then fastened at the wearer's chest, and the hip belt buckle is fastened at the front of the wearer's abdomen. The upper and lower flexible portions 12 and 15 are adjusted by means of their adjustment buckles to provide a tight fit for the chest strap arrangement A while allowing easy breathing of the wearer as will be discussed below. The hip belt is similarly tightened to provide a comfortable yet secure fit around the wearer's abdomen so that the hip belt C rests on the wearer's hips.

When the wearer is stationary and standing upright as shown in FIG. 2, the load in the pack P is secured to the wearer's upper torso by the chest strap arrangement A and so is prevented from falling backwards away from the wearer's torso. However, the weight of the load in the pack P is transferred by the strut mechanism B substantially entirely to the hip belt C and is then spread sideways from the single point connection 1 onto the hips of the wearer. The single point connection 1 is situated centrally at the back of the hip belt C and at the top of the hip belt C so as to maximise the use of the concave curvature of the wearer's lumbar region (i.e. the small of the back) to bring the point of application of the load at the single point connection 1 as far forward into the wearer's back as possible. The rod 2 serves as the sole component transferring the load from the pack P to the hip belt C. The spring 5 in the strut mechanism B resists compression but allows extension by sliding of the rod 2 in the cylinder 8. Also, the flexibility of the rod 2 allows relative movement between the support structure 9, 10 and the hip belt C in lateral, forwards and backwards directions.

The resistance to compression of the strut mechanism B ensures that the weight of the load in the pack P is fully transferred into the hip belt C to be supported by the wearer's hips. The strut mechanism B extends from the top of the hip belt C at the lowest part of the lumbar region up the full length of the lumbar region to meet the support structure 9, 10 in the thoracic region of the wearer's torso. As a result, the strut mechanism covers the full length of the lumbar region where the most flexion and extension of the wearer's spine will occur during typical movement. The flexibility and free extension of the strut mechanism B enables the chest strap arrangement A, and the load in the pack P, to move in all directions independently of the hip belt C so as to avoid any restriction of the wearer's movements.

The spring 5 supports the weight of the load throughout the range of extension of the strut mechanism B. The spring 5 may be replaced by a series of springs, which may have different spring rates so that in the fully extended position the spring rate of the strut mechanism B as a whole is low, but increases as the springs are compressed. This enables the spring rate to adjust automatically for different weights of load in the pack P.

Movement of the load is damped by controlling the movement of the piston 4 within the cylinder 8. The head of the piston 4 is flanged as shown so that in the compression stroke, as the weight of the load pushes down on the cylinder so that the piston 4 moves towards the top end of the cylinder 8, air can easily escape past the piston head. However, in the extension stroke, as the recoil force of the spring or springs five brushes upwards on the cylinder 8 so that the piston 4 moves towards the bottom of the cylinder 8, the air pressure above the piston 4 decreases. The greater air pressure below the piston 4 forces the flange of the piston head against the sides of the cylinder, thereby restricting the movement of their past the piston 4. The resulting air pressure differential resists the movement of the piston 4 relative to the cylinder 8 and thereby provides a velocity-dependent damping force on the movement of the load under the action of the springs 5 during the extension phase of the cycle. A hole 6 near the top of the cylinder 8 allows air to flow between the ambient surroundings and the interior of the cylinder 8 in either direction. The damping effect may be varied by changing the flow passage of the hole 6 by means of an adjusting screw 7 fitted within the hole 6. This enables the damping effect to be adjusted from a relatively soft rating with a low damping effect to maximise comfort for slow activities such as walking, and a hard rating with a high damping effect for faster or more vigorous activities such as running where extreme movements would otherwise destabilise the wearer.

The damping mechanism provided by the piston 4 and the cylinder 8 is thus a one-way mechanism which damps movement on the extension cycle when the springs 5 are in recoil but not on the compression cycle when the weight of the load is compressing the springs. It will be appreciated that the damping system shown in FIG. 3 is only one possible mechanism which can provide the desired effect. Other damping mechanisms, example a simple friction damper, a gas strut or a hydraulic linear decelerator could be used to produce the same result.

To achieve a comfortable fit, the optimal distance between the hip belt C and the chest strap arrangement A, with the wearer in a static, upright position, will vary from individual to individual. Also, the required static length of the strut mechanism B will vary depending on the load carried in the pack P, since a heavy load will compress the springs 5 more than a light load. For these reasons, and adjustment mechanism to vary the static length of the strut mechanism B is desirable. Suitable mechanisms will be apparent to the skilled person, such as a screw threaded adjustment mechanism as shown in FIG. 1, in which the cylindrical sleeve 11 can be rotated on a screw threaded column 32 attached to the hip belt C to adjust the overall length of the strut mechanism B to suit the individual wearer and/or the load to be carried.

When the wearer is standing still and upright, the weight of the load in the pack P is transmitted from the lateral spars 10 to the central spar 9 and thence to the cylinder 8 to compress the springs 5 until a static equilibrium position is reached. Provided that the strut mechanism B is adjusted to a sufficient length, the rigidity of the support structure 9, 10 ensures that the weight of the load is transferred directly into the strut mechanism B so that it is supported by the hip belt C, and the chest strap arrangement 12, 15 does not provide any vertical support for the load. From this steady-state condition, forwards bending of the wearer will lift some of the weight of the load from the strut mechanism B and this will be taken by the wearer is inclined back. This movement is accompanied by extension of the springs 5 so that the strut mechanism increases in length to match the increased distance between the chest strap arrangement a and the hip belt C. Static equilibrium is thus restored in this new position, with the load supported in part by the hip belt C and in part by the wearer's inclined back, but the chest strap arrangement 12, 15 still does not support any substantial portion of the load. The effect of this is that no weight is carried by the shoulders, nor are there any forces pulling the hip belt C off its secure position on the wearer's hips. The piston-cylinder unit 4, 8 and the springs 5 need to accommodate an extension of around 6 cm in the spine of an average wearer from fully loaded to fully extended as the wearer moves from an upright position to a "touching toes" position. During typical walking motions the load will move up and down and the kinetic energy will be absorbed and returned by the springs 5 reducing the impact on the wearer's hips. The damping effect will be slight at these low speeds. During faster movement such as running, the kinetic energy produced by the moving load is greater. The springs respond to absorb and return this great energy and, in an undamped system, would exacerbate the amplitude of the load's cycle. However, the damping achieved by the configuration of the head of piston 4, which has more effect at great speeds, controls the movement of the load and the cycle amplitude to keep them within the tolerances of the wearer's natural gait; this is perceived by the wearer as reducing the "bounce" of the rucksack when running.

The chest strap arrangement A is in the general form of an X-harness. It serves to secure the vertical central spar 9 over the wearer's spine between the shoulder blades. From this vertical spar 9 the support structure 9, 10 extends left and right across the top of the back above the shoulder blades to the top corners of the pack P, which sit higher than the wearer's shoulders. The lateral spars 10 then descend from the top corners of the pack P down the sides of the pack. The upper flexible portions 12 of the chest strap arrangement A, which can be regarded as shoulder straps, extend from the support structure 9, 10 over the front of the clavicle blown on each side of the wearer's neck and down across the wearer's chest at a high enough position to avoid the pectoral muscles, to the buckle 14 disposed over the wearer's sternum. The lower flexible portions 15 of the chest strap arrangement A, which can be regarded as abdomen straps, are connected to the lateral spars 10 of the support structure at approximately the level at which these lateral spars 10 are connected to the central spar 9, which coincides generally with the lower part of the thoracic region of the wearer. The abdomen straps 15 extend from this position around the rib cage to the lower ends of the flexible wands 16. The shoulder straps 12 and the abdomen straps 15 are all adjustable to provide a comfortable fit on the wearer The buckle 14 comprises a left component connected to the left shoulder strap 12 and the left abdomen strap 15, so that when the buckle is unfastened as in I FIG. 1, the left shoulder strap 12, the left component of the buckle 14, the left abdomen strap 15, the flexible wand 16 and the vertical spar 9 running down the wearer's spine together form a single continuous loop. The corresponding components on the right of the wearer form a similar single continuous loop. The left and right components of the buckle 14, when interconnected, form a rigid unit so that the two components are fixed in position with respect to each other. The interconnected buckle has a relatively narrow profile so as to avoid interfering with the pectoral muscles or breasts of the wearer.

Figure 4A:
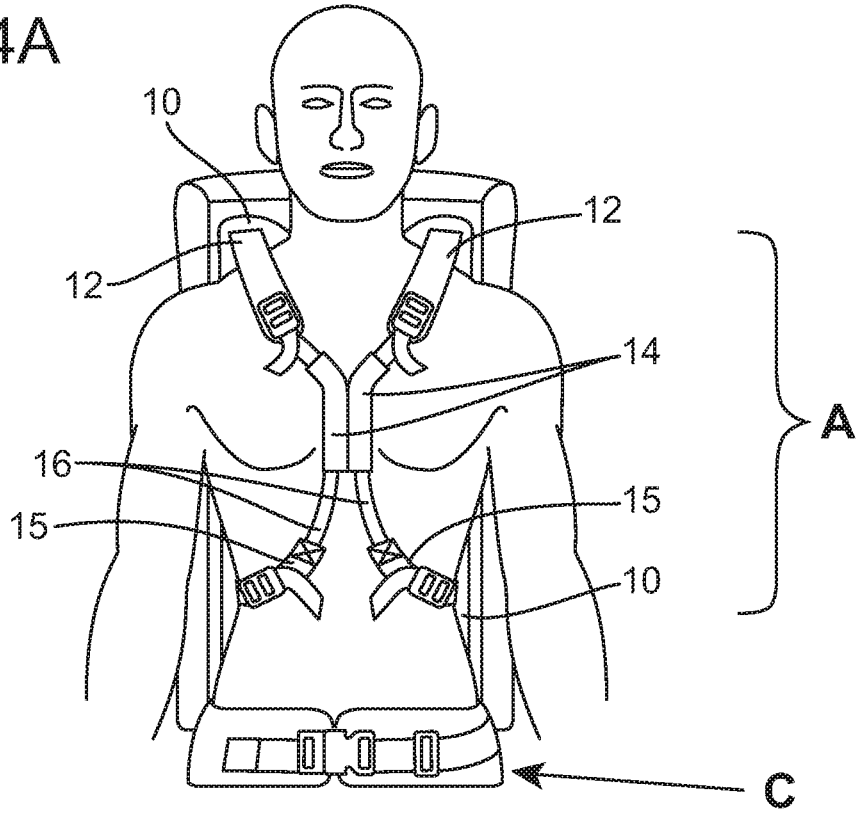
FIGS. 4*a* and 4*b* show a strap arrangement of the rucksack of FIGS. 1 and 2 in different configurations.
Figure 4B:
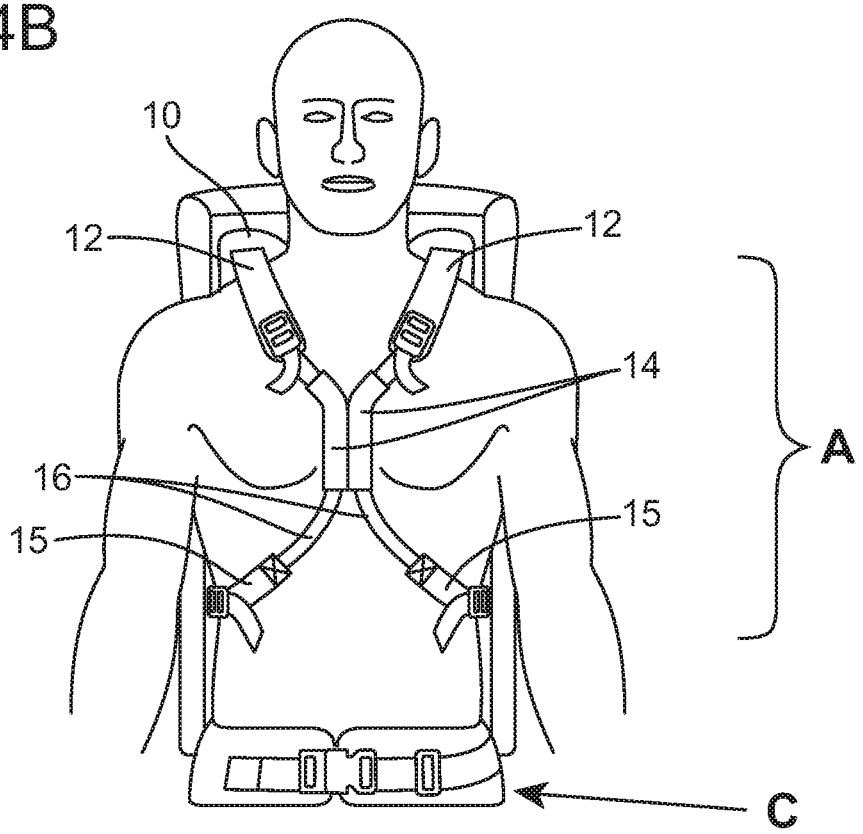

Each flexible wand 16 is rigidly secured to the respective component of the buckle 14 and extends downwardly for several centimetres (for example at least 8 cm or 10 cm) below the sternum. The flexible wands 16 are substantially inextensible in the lengthwise direction so as to resist linear forces, but are flexible laterally. The left abdomen strap 15 is connected to the bottom of the flexible wand 16 on the left buckle component and the right abdomen strap 15 is connected to the bottom of flexible wand 16 on the right buckle component The shoulder straps 12 are connected to the top of the respective buckle component at an angle so that, when the buckle 14 is connected in use the forces are directed diagonally across the wearer's torso from the left shoulder strap 12 through the buckle 14 and the wand 16 to the right abdomen strap 15 and from the right shoulder strap 12 the forces are directed through the buckle 14 and the wand 16 to the left abdomen strap 15. Since the shoulder straps 12, the abdomen straps 15, the buckle components 14 and the flexible wands 16 are substantially inextensible, the components form two close-fitting loops running diagonally around the wearer's body to secure the chest strap arrangement to the wearer's torso. Because the wands 16 are laterally flexible, the gap between the bottom ends of the wands 16 can increase and decrease with the expansion and contraction of the wearer's rib cage during breathing. This is shown in FIGS. 4*a* and 4*b*. FIG. 4*a* shows the wands 16 extending generally vertically downwards from the buckle 14 when the wearer has fully exhaled, while FIG. 4*b* shows the wands 16 pulled apart sideways by the abdomen straps 15 when the wearer has inhaled and the rib cage is fully expanded. The variation in the horizontal distance around the lower part of the wearer's rib cage during breathing is accommodated in this manner while maintaining a substantially constant length for the diagonal loop comprising the left shoulder strap 12, the buckle component 14, the wand 16 and the right abdomen strap 15 and vice versa. The chest strap arrangement A thus remains securely fastened to the wearer's torso, ensuring that the pack P remains held tightly against the wearer's back.

The structure of the buckle 14 and the flexible wands 16 thus allow the wearer to breathe freely while fitting securely around the wearer's torso at positions which move little as the posture of the wearer changes during normal body movements such as walking and running or when bending forwards, backwards or sideways. This minimises the shifting of the straps 12, 15, rubbing against the wearer's body, or slack in the chest strap arrangement A. Also, the load is securely and comfortably fixed to the wearer's back, with the chest strap arrangement A sitting on the wearer's skeletal structure while avoiding large muscle groups so reducing muscle fatigue and strain and facilitating heat loss.

The back panel 13 of the pack P is relatively stiff to ensure that the contents of the pack do not bulge between the spars 9, 10 of the support structure to interfere with the wearer's body. Padding is provided over the entire central spar 9 and the area of the support structure 9, 10 extending across the top of the back above the shoulder blades. This padding serves to cushion the impact of the harness on immovable parts of the wearer's torso and also serves to hold the back panel 13 away from the wearer's body to ensure that the shoulder blades are free to move unconstrained. This also facilitates heat loss out of the side of the pack, which may be further improved by means of channels in the padding. The flexible guiding rod 2 of the strut mechanism B lies between the wearer's back and the pack P passing through the hole 17 in the back panel 13 and down to the hip belt C.

The pack P is held slightly away from the wearer's back by the shaping of the support structure 9, 10 and the stiffness of the back panel 13 to ensure the flexible guiding rod 2 is free to move without interference with the wearer's back.

Any movement of the wearer while wearing the harness will create mechanical stress on the strut mechanism B. The damping provided by the cooperation between the piston 4 and the cylinder 8 serves as a shock absorber to damp the stresses and manage load fluctuations on the wearer's body by dissipating the kinetic energy generated. As an optional variant, a piezoelectric device or other electrical generator may be incorporated into the strut mechanism B to convert the kinetic energy generated by movement of the load into electrical energy to charge and electrical device, example a device constituting part of, or accommodated within, the pack P.

Figure 5:
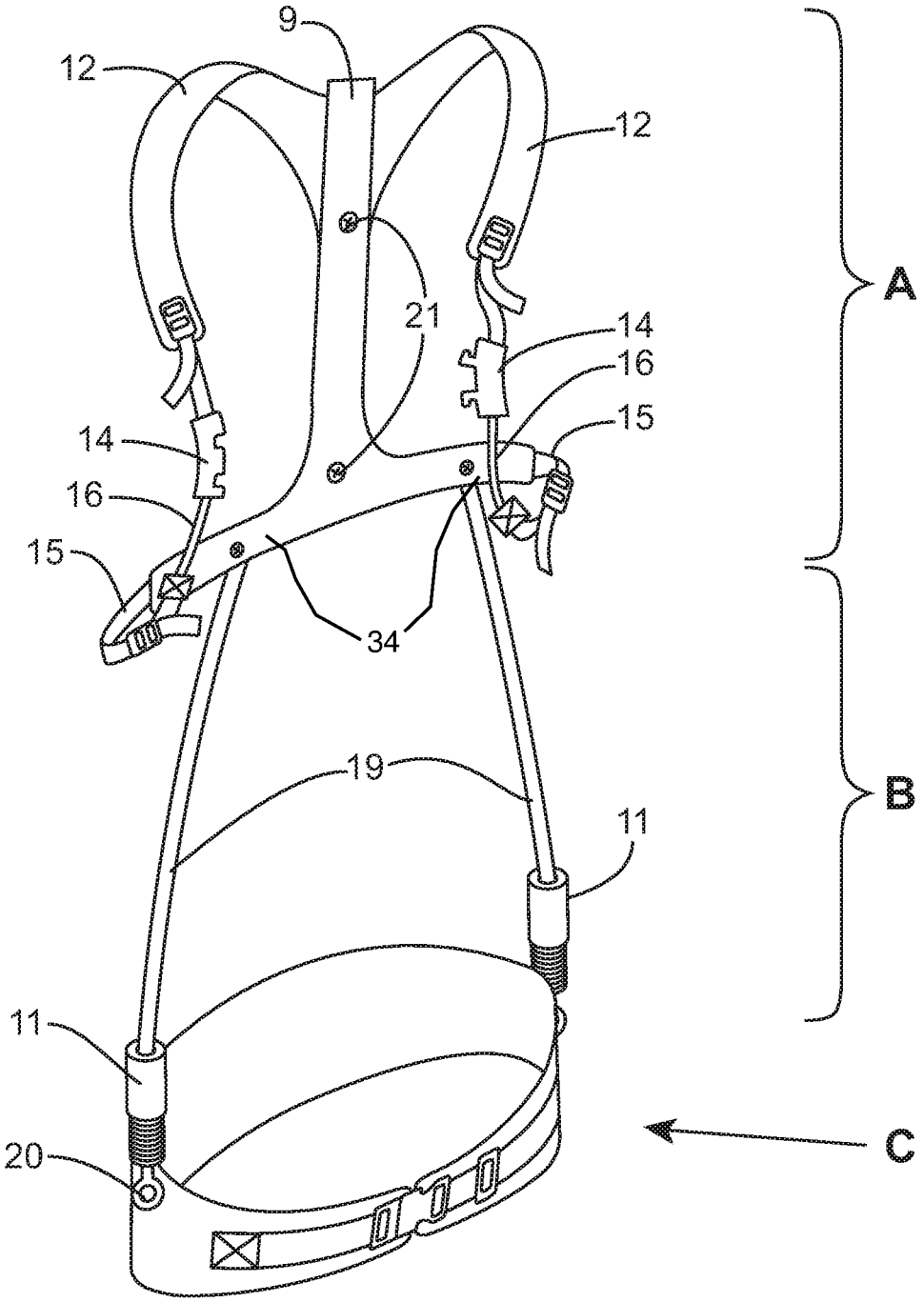
FIG. 5 shows a support frame of an alternative embodiment of a rucksack.

Although the embodiment of FIGS. 1 to 4 shows a single point attachment 1 between the support structure 9, 10 and the hip belt C, the strut mechanism may comprise multiple connections. For example, as shown in FIG. 5, the strut mechanism B may comprise a pair of gas struts 19 which are connected to the hip belt C at the hips themselves by means of hinged connections 20 which enable the gas struts to pivot forwards and backwards relatively to the hip belt C. The gas struts 19 extend upwardly from the hip belt to the lateral wings 34 of the central spar 9. While the gas struts 19 of the embodiment of FIG. 5 provide the same general function as that of the strut mechanism B of FIGS. 1 to 4, they do not require the lateral flexibility of the flexible rod 2. Instead, lateral flexibility of the mechanism is achieved by a difference in extension between the two gas struts 19, while forward, backward and torsional flexibility is achieved by the hinged connections 20 at the hip belt C combined, when necessary, with differential extension of the struts 19. The arrangement of FIG. 5 requires an increased extension capability compared with that of FIGS. 1 to 4, but the struts 19 themselves can be substantially rigid. Both of the gas struts 19 require length adjusters 11 to accommodate different loads and lengths of wearer's backs, so that a comfortable fit for the wearer can be achieved and the strut mechanism B is long enough for the entire weight of the load in the pack P to be transferred into the hip belt C relieving the shoulder straps 12 from the weight of the load.

The use of the gas struts 19 inherently provides a sprung, damped system in the strut mechanism B, but an alternative possibility is to replace the gas struts with rigid rods incorporating sprung, damped systems such as shown in FIG. 3 positioned at the junction between the rigid rods and the wings 34 of the central spar 9.

FIG. 5 shows the harness without any load such as the pack P of FIGS. 1 and 2. In the absence of a pack requiring a relatively rigid supporting frame, the shoulder straps 12 extend from the central spar 9 at position close to the centre of the back of the wearer and run, as flexible components, laterally outwards from the wearer's spine, over the shoulder, and down towards the respective buckle component 14. The load can be attached to the central spar 9 at attachment points 21 so that the rigidity of the central spar 9 ensures that the weight of the load is transferred to the gas struts 19 an offence to the hip belt C.

Figure 6:
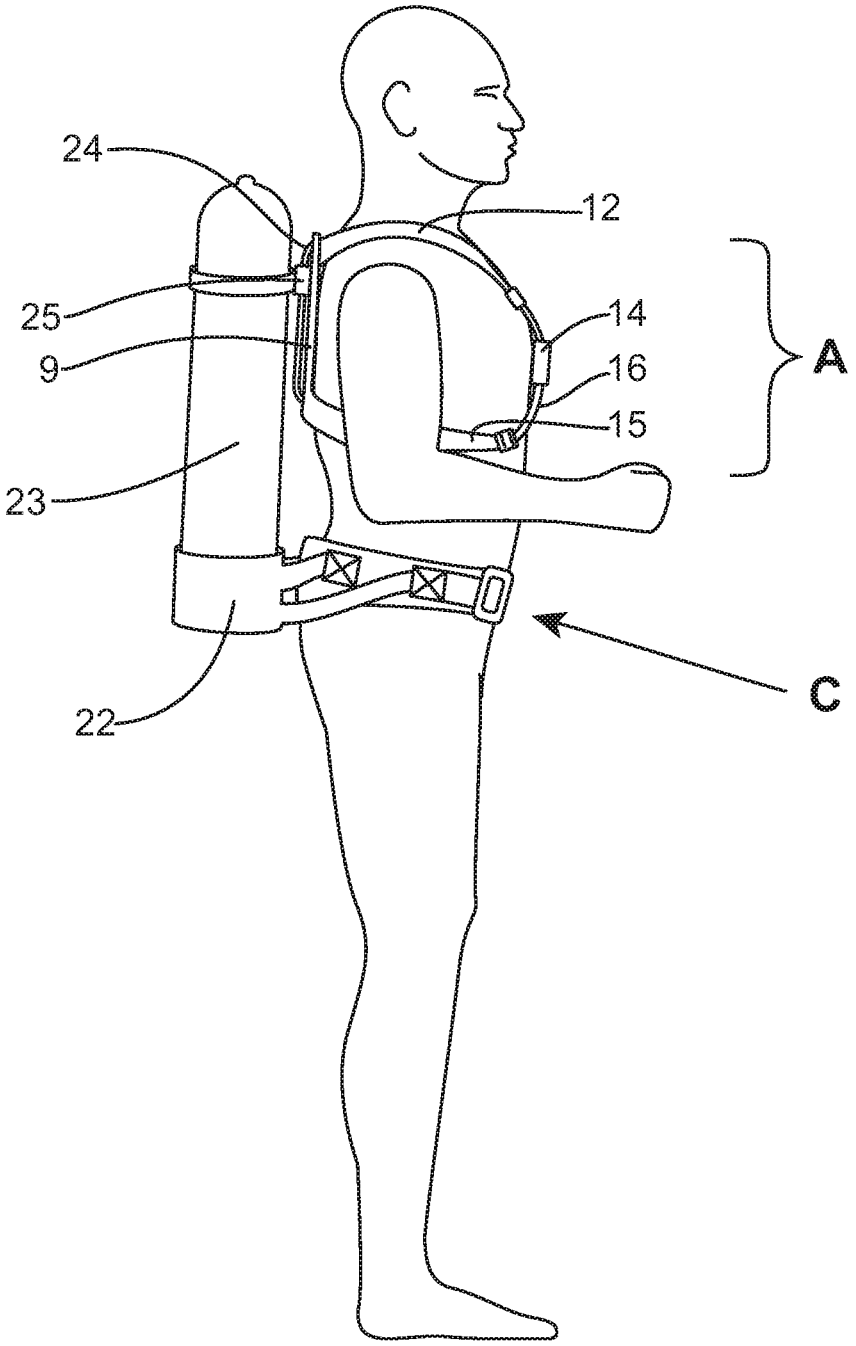
FIG. 6 shows a harness positioned on a wearer and supporting a gas cylinder.

FIG. 6 shows an embodiment in which a load in the form of a gas cylinder 23 is secured directly to the hip belt C and is connected to the support structure 9 by a free-running connection which is shown, by way of example, as a rail 24 on the central spar 9 of the support structure and a runner 25 secured to the upper part of the cylinder 23.

The load (i.e. the gas cylinder 23) may be secured to the hip belt using elastic connections 22 to create a sprung loading system. The runner 25 is connected to the load 23 in a pivotable manner so that it can accommodate sideways twisting of the chest strap arrangement a relative to the hip belt C. As with the previous embodiments, complete separation of the chest strap arrangement A and the hip belt C is achieved so that the full weight of the load is carried by the hip belt C. the elastic connection 22, if provided, between the load and the hip belt C may be made of a material with memory properties to create a complete sprung, damped system, alternatively a damping system such as a friction damper could be incorporated into the mechanism comprising the rail 24 and the runner 25.

In the embodiment of FIG. 6, the shoulder straps 12, abdomen straps 15, buckle 14 and flexible wands 16 are constructed in the same manner as those of the previous embodiments.

The embodiments of the present invention that have been described above enable the chest strap arrangement A and the hip belt C to move independently of each other while retaining the support of the load on the hips by way of the hip belt C. As shown, for example, in FIG. 1, the connection between the strut mechanism B and the chest strap arrangement A is at the bottom of the central spar 9. Since most of the extension of the wearer's spine during normal body movements occurs in the lumbar region, this arrangement is adequate in most circumstances. However, some extension and flexion occurs in the thoracic region, and consequently a more ergonomic fit may be provided by connecting the flexible rod 2 to the support structure 9, 10 at a higher position than is shown in FIG. 1.

It will be appreciated that, as is conventional, the shoulder straps 12 and abdomen straps 15, as well as the hip belt C may be made of flexible webbing material or other suitable material known for use in rucksacks and similar load carrying devices. Padding may be provided to increase the comfort of the wearer, both on the flexible straps and on the support structure 9, 10 and any other components of the harness and the pack which contact parts of the wearer's body.

The invention claimed is:

1. A harness for carrying a load, comprising:

a support structure;

a strap arrangement provided on the support structure for retaining the support structure adjacent a wearer's back, the strap arrangement comprising a left chest strap and a right chest strap, each of the left and right chest straps defining a loop extending from a first position on the support structure on one side of the support structure to a second position below the first position on the same side of the support structure;

a releasable buckle which interconnects the chest straps, in use, at the front of the wearer, the releasable buckle comprising a left buckle component and a right buckle component, each of the buckle components having a respective upper fastening point and a respective lower fastening point, the buckle components, when engaged with each other, forming a rigid interconnection between the loops, whereby in use forces in the chest straps are directed diagonally across the wearer's torso through the buckle; and a pair of links, each link being in the form of an inextensible wand which is selected from being resiliently flexible in bending or rigid and is connected to a respective buckle component in a resiliently pivoting manner, and comprising a first end and a second end, the first end of each wand being connected respectively to the lower fastening points of the left and right buckle components, wherein each of the loops comprises:

a flexible shoulder strap extending from the support structure to the upper fastening point on the respective buckle component, and a flexible abdomen strap extending from the support structure to an attachment point at the second end of the respective wand, the wands extending downwards from the buckle when the wearer has fully exhaled, and being laterally resiliently displaced apart from each other by the abdomen straps as the wearer inhales, whereby the attachment points of the abdomen straps are laterally flexible towards and away from each other by resilient deflection of the wands, such that a gap disposed between the second ends of the wands increases and decreases with the expansion and contraction, respectively, of the wearer's rib cage during breathing.

2. A harness as claimed in claim 1, wherein the loop of each chest strap is made from an inextensible material.

3. A harness as claimed in claim 1, wherein the length of each loop is adjustable.

4. A harness as claimed in claim 1, wherein each inextensible wand is resiliently flexible in bending.

5. A harness as claimed in claim 4, wherein each flexible wand is rigidly connected to the respective buckle component.

6. A harness as claimed in claim 1, wherein each inextensible wand is rigid and is connected to the respective buckle component in a resiliently pivoting manner.

7. A harness for carrying a load, comprising:

a support structure;

a strap arrangement provided on the support structure for retaining the support structure adjacent a wearer's back, the strap arrangement comprising a left chest strap and a right chest strap, each of the left and right chest straps defining a loop extending from a first position on the support structure on one side of the support structure to a second position below the first position on the same side of the support structure;

a releasable buckle which interconnects the chest straps, in use, at the front of the wearer, the releasable buckle comprising a left buckle component and a right buckle component, each of the buckle components having a respective upper fastening point and a respective lower fastening point, the buckle components, when engaged with each other, forming a rigid interconnection between the loops, whereby in use forces in the chest straps are directed diagonally across the wearer's torso through the buckle; and a pair of links, each link being in the form of an inextensible wand which is resiliently flexible in bending, and comprising a first end and a second end, the first end of each wand being connected respectively to the lower fastening points of the left and right buckle components, wherein each of the loops comprises:

a flexible shoulder strap extending from the support structure to the upper fastening point on the respective buckle component, and a flexible abdomen strap extending from the support structure to an attachment point at the second end of the respective wand, the wands extending downwards from the buckle when the wearer has fully exhaled, and being laterally resiliently displaced apart from each other by the abdomen straps as the wearer inhales, whereby the attachment points of the abdomen straps are laterally flexible towards and away from each other by resilient deflection of the wands, such that a gap disposed between the second ends of the wands increases and decreases with the expansion and contraction, respectively, of the wearer's rib cage during breathing, the harness further comprising:

a strut mechanism in the form of a telescopic strut which connects the hip belt to the support structure and is disposed substantially centrally of a wearer's back and connected to the support structure in the thoracic region of the wearer's torso when in use, the strut mechanism being the sole force-transmitting connection between the hip belt and the support structure, the strut mechanism comprising:

a piston displaceable in a cylinder, the piston and the cylinder being connected respectively to one and the other of the hip belt and the support structure to permit displacement of the support structure towards and away from the hip belt, a laterally flexible piston rod which connects the piston to the respective hip belt or support structure to permit lateral and forwards and backwards movement of the support structure with respect to the hip belt, and a spring which acts between the cylinder and the piston in a direction to extend the strut, whereby, in use, the strut mechanism resiliently biases the support structure upwards with respect to the hip belt.

* * * * *